US009310083B2

(12) United States Patent
Bunel et al.

(10) Patent No.: US 9,310,083 B2
(45) Date of Patent: Apr. 12, 2016

(54) COMBUSTION CHAMBER FOR AN AIRCRAFT ENGINE, AND METHOD FOR ATTACHING AN INJECTION SYSTEM IN A COMBUSTION CHAMBER OF AN AIRCRAFT ENGINE

(75) Inventors: Jacques Marcel Arthur Bunel, Moissy-Cramayel (FR); Brice Arnaud Demoulin, Moissy-Cramayel (FR); Mario César De Sousa, Moissy-Cramayel (FR); Guillaume Sevi, Moissy-Cramayel (FR)

(73) Assignee: SNECMA, Paris (FR)

( * ) Notice: Subject to any disclaimer, the term of this patent is extended or adjusted under 35 U.S.C. 154(b) by 504 days.

(21) Appl. No.: 13/819,113

(22) PCT Filed: Aug. 12, 2011

(86) PCT No.: PCT/FR2011/051909

§ 371 (c)(1),
(2), (4) Date: Feb. 26, 2013

(87) PCT Pub. No.: WO2012/025682

PCT Pub. Date: Mar. 1, 2012

(65) Prior Publication Data

US 2013/0152603 A1 Jun. 20, 2013

(30) Foreign Application Priority Data

Aug. 27, 2010 (FR) ..... 10 56831

(51) Int. Cl.
*F02C 7/20* (2006.01)
*F23R 3/60* (2006.01)
(Continued)

(52) U.S. Cl.
CPC ... *F23R 3/60* (2013.01); *F23R 3/14* (2013.01); *F23R 3/28* (2013.01); *F23R 3/283* (2013.01); *F23R 2900/00017* (2013.01); *Y10T 29/49323* (2015.01)

(58) Field of Classification Search
CPC ..... F23R 3/286; F23R 3/283; F23R 3/32; F23R 3/60
See application file for complete search history.

(56) References Cited

U.S. PATENT DOCUMENTS 5,222,358 A * 6/1993 Chaput et al. ..... 60/796
5,577,379 A * 11/1996 Johnson ..... 60/796
(Continued)

FOREIGN PATENT DOCUMENTS

EP 0 469 899 B1 6/1994
EP 1 731 837 A2 12/2006
(Continued)

OTHER PUBLICATIONS

International Search Report as issued for PCT/FR2011/051909.

*Primary Examiner* — Gerald L Sung
(74) *Attorney, Agent, or Firm* — Pillsbury Winthrop Shaw Pittman LLP

(57) ABSTRACT

A combustion chamber in which the injection system is attached so as to prevent any axial motion of the injection system, the combustion chamber includes: a baffle including a tubular portion having a first upstream end surrounded by a first radially projecting collar; and an injection system including a bowl which includes a cylindrical portion inserted into the tubular portion, the cylindrical portion including a second upstream end surrounded by a second radially projecting collar, the second collar axially bearing against the first collar, wherein the combustion chamber includes a clamp which axially clamps the first and the second collars against one another, and a fastener which retains the clamp clamped on either side of the first and second collars.

14 Claims, 6 Drawing Sheets

(51) Int. Cl.
*F23R 3/14* (2006.01)
*F23R 3/28* (2006.01)

(56) References Cited

U.S. PATENT DOCUMENTS

2005/0044854 A1* 3/2005 Cazalens et al. ..... 60/740
2007/0084215 A1* 4/2007 Hernandez et al. ..... 60/796
2007/0269757 A1* 11/2007 Commaret et al. ..... 431/265
2011/0113789 A1* 5/2011 Duval et al. ..... 60/796
2011/0271682 A1* 11/2011 Sandelis ..... 60/737

FOREIGN PATENT DOCUMENTS

EP 1 731 839 A2 12/2006
EP 1 873 454 A1 1/2008
EP 1 873 458 A1 1/2008
FR 2 932 251 A1 12/2009
FR 2 941 288 A1 7/2010
FR 1 056 125 A 1/2012

* cited by examiner

Fig. 4
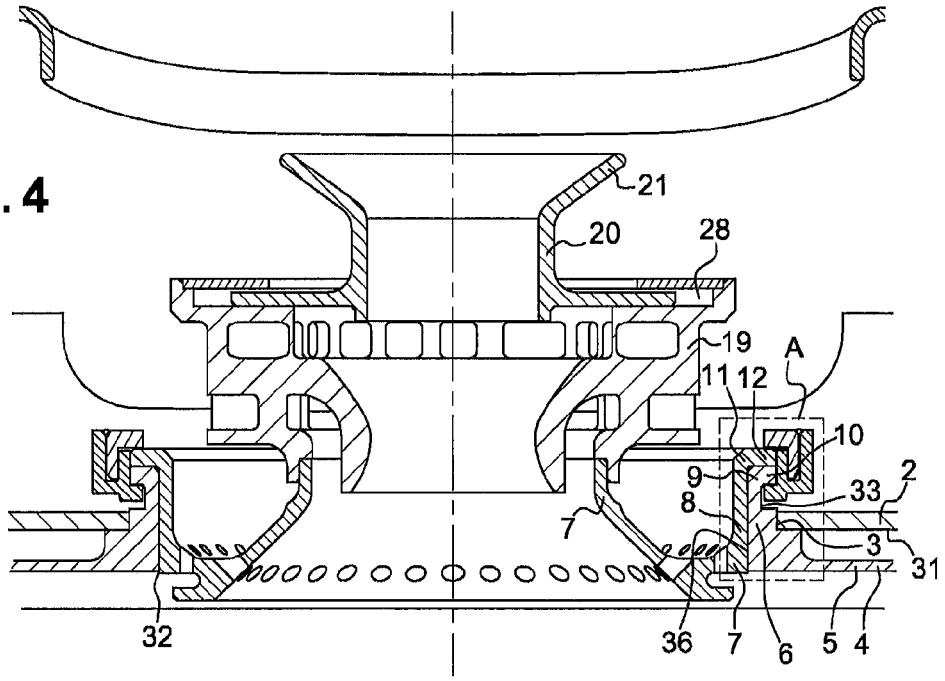
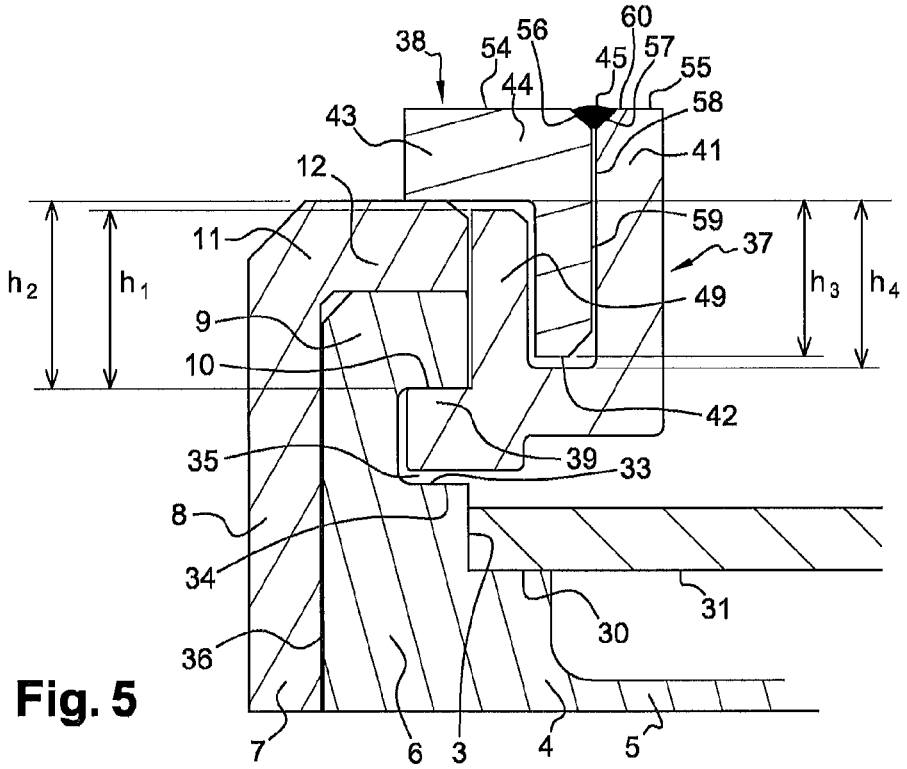
Fig. 5

COMBUSTION CHAMBER FOR AN AIRCRAFT ENGINE, AND METHOD FOR ATTACHING AN INJECTION SYSTEM IN A COMBUSTION CHAMBER OF AN AIRCRAFT ENGINE

CROSS-REFERENCE TO RELATED APPLICATIONS

This is the U.S. National Stage of PCT/FR2011/051909, filed Aug. 12, 2011, which in turn claims priority to French Patent Application No. 1056831, filed Aug. 27, 2010, the entire contents of all applications are incorporated herein by reference in their entireties.

TECHNICAL FIELD

The present invention relates to a combustion chamber for an aircraft engine in which an injection system is attached. The present invention also relates to a method for attaching an injection system in a combustion chamber of an aircraft engine and an aircraft engine comprising a combustion chamber according to the invention.

REVIEW OF THE PRIOR ART

The combustion chambers in turbojet engines generally comprise an internal wall and an external wall, the upstream ends of which are connected via an annular base in such manner as to define a base of the combustion chamber. Injection systems, which are normally distributed about the periphery of the combustion chamber base, deliver a mixture of air and fuel that is ignited to supply combustion gases. Each combustion system comprises a venturi in which the air and the fuel are mixed. Each injection system also includes a bowl, located downstream of the venturi, the function of which is to explode the jet air/fuel mixture exiting the venturi. In addition, a baffle protects the chamber base from the flames in the combustion chamber.

FIG. 1 represents a system for attaching an injection system 1 inside an aircraft engine combustion chamber according to the prior art. Chamber base 2 of the combustion chamber is perforated by an orifice 3 in which a baffle 4 is inserted. Baffle 4 is soldered onto chamber base 2. Baffle 4 comprises a plate 5 from which a tubular portion 6 protrudes. Tubular portion 6 is cylindrical and extends in the direction of a reference axis Y. Combustion system 1 includes a spiral structure 19 on which is mounted a sliding cross piece 20 capable of sliding radially relative to spiral structure 19. Sliding cross piece 20 comprises a centring cone 21 into which an injector nozzle (not shown) will be inserted. The injection system also comprises a bowl 7 attached permanently to spiral structure 19. Bowl 7 comprises a cylindrical portion 8 that has a rotational symmetry about reference axis Y. Cylindrical portion 8 of the bowl is inserted in tubular portion 6 of the baffle. Tubular portion 6 of the baffle also has an upstream end 9 that is surrounded by a first radially projecting collar 10. Cylindrical portion 8 of the bowl also has an upstream end 11 that projects from upstream end 9 of tubular portion 6. Upstream end 11 of the cylindrical portion is surrounded by a second radially projecting collar 12. Second collar 12 bears axially against first collar 10. The injection system is attached to baffle 4 by means of two half-rings 13 that are inserted radially in an annular channel 35 located downstream of the first collar. Half-rings 13 are also arranged in such manner that they surround the first and second collars. Each half-ring 13 has a first retaining lip 14 that engages below first collar 10 and a second retaining lip 15 that engages above second collar 12 in such manner that the two collars 10 are 12 are trapped axially between the two retaining lips 14 and 15 and radially by the lateral walls 16 of the two half-rings 13.

A cylindrical retaining ring 17 is then placed around the two half-rings 13 so as to prevent the two half-rings 13 from separating from one another radially. Weld beads 18 join retaining ring 17 permanently to the two half-rings 13.

FIG. 2 shows an enlarged view of the two collars 10 and 12, surrounded by half-rings 13, which in turn are capped by retaining ring 17. This system for attaching injection system 1 to the combustion chamber can be implemented easily.

However, the applicant has discovered that with such an attachment system the nozzle of the fuel injector that is inserted in the injection system suffers significant wear and the service life thereof is shortened.

Documents EP1873454, EP1731839 and EP1873458 also describe combustion chambers in which the nozzle of the injector has a shortened service life and subject to substantial wear.

BRIEF SUMMARY OF THE INVENTION

The object of the invention is to address the drawbacks of the prior art, at least in part, by suggesting a combustion chamber that is more resistant to wear and has a longer service life.

To do this, the invention suggests the use of an attachment system for the first and the second collars that prevent any movement of the injection system relative to the baffle. In fact, the applicant has discovered that vibrating action of the first and second collars if they are allowed to move between the two retaining lips of half-rings 13 amplifies the phenomenon of wear on the fuel injector and thereby shortens the service life of the combustion chamber.

More precisely, a first aspect of the invention relates to an aircraft engine combustion chamber including at least:

- a baffle comprising at least one tubular portion, the tubular portion extending in the direction of a reference axis, the tubular portion having a first upstream end surrounded by a first radially projecting collar;
- an injection system comprising at least one bowl which in turn comprises a cylindrical portion inserted into the tubular portion, the cylindrical portion comprising a second upstream end that exits the first upstream end of the tubular portion, the second upstream end of the cylindrical portion being surrounded by a second radially projecting collar, the second collar being braced axially against the first collar;

the combustion chamber further comprising:
- clamping means that clamp the first and the second collars against one another axially, and
- attachment means that retain the clamping means clamped on either side of the first and second collars.

Thus, in the combustion chamber according to the invention, the injection system is attached to the baffle by clamping means that prevent any axial movement of the second collar relative to the first collar, such that the injection system is unable to vibrate with respect to the chamber base. Consequently, the wear on the injector nozzle that is inserted in the injection system is reduced.

The combustion chamber according to the invention may also have one or more of the features listed in the following, either individually or in any technically possible combination thereof.

According to one embodiment, the clamping means comprise two jaws, one of the jaws bearing axially against the first collar, and the other jaw bearing axially against the second collar, the two jaws clamping the two collars axially between them, and the attachment means holding the two jaws clamped on either side of the two collars.

The two jaws advantageously extend circumferentially around the two collars.

According to a preferred embodiment, the clamping means comprise:

A retaining bushing split into at least two bushing parts, the retaining bushing comprising at least:

a retaining ring bearing axially against the first collar, and a peripheral retaining skirt projecting axially from the retaining ring, the peripheral retaining skirt surrounding the first and second collars radially, A retained bushing comprising at least:

a retained ring bearing axially against the second collar, and a peripheral retained skirt projecting axially from the retained ring, the peripheral retained skirt surrounding the peripheral retaining skirt radially;

the attachment means holding together the retaining bushing and the retained bushing such that the retaining ring and the retained ring hold the first and second collars clamped against one another so that no relative axial movement is between the two is possible.

Thus, according to preferred embodiment, the retaining bushing is split into a plurality of bushing sections to enable it to be inserted downstream of the first collar. In fact, if the retaining bushing were constructed from a single part, it could not be mounted downstream of the first collar.

In this document, the terms "downstream" and "upstream" refer to the direction of the flow of combustion gases inside the cylindrical portion.

The retained peripheral skirt of the retained bushing, which is located upstream of the first and second collars, is constructed from a single part, and this enables the sections of the bushing that constitute the retaining bushing to be held together.

The retained peripheral skirt and the retaining peripheral skirt thus make it possible to limit the radial movements of the first and second collars.

The retained ring is positioned such that it bears axially against the second collar, and the retaining ring is positioned such that it bears axially against the first collar, so that the first and the second collars are clamped axially between these two rings. These two rings thus prevent all axial movement of the second collar relative to the first collar.

The portions of the bushing that constituent the retaining bushing are advantageously two half-bushings, such that the retaining bushing is divided into two half-bushings. Each element of the retaining bushing is also split into the same number of sections as the retaining bushing.

Consequently, when the retaining bushing is split into two sections, the retaining ring is also split into two sections, as is the retaining peripheral skirt.

The tubular portion is advantageously cylindrical.

Besides a lateral wall, the tubular portion advantageously has a shoulder that projects radially from said lateral wall, an annular channel that is defined between the first collar and the shoulder, the retaining ring being inserted inside the annular channel.

The lateral wall extends parallel to the reference axis.

The annular channel is advantageously delimited transversely by the first collar, with projects radially from the lateral wall, and by a shoulder of the lateral. The first collar thus forms the upstream wall of the annular channel, while the shoulder of the lateral wall forms the downstream wall of the annular channel. The retaining ring, which is inserted in the annular channel, bears axially against the first collar.

The attachment means advantageously include:

at least two attachment lugs joined to the retaining bushing, said lugs combining with the retaining peripheral skirt to form a peripheral channel in which the retained peripheral skirt is inserted, at least one welded joint that fastens each attachment lug to the retained bushing.

According to different embodiments:

the welded joint may be discontinuous, such that weld spots join each attachment lug to the retained bushing, or the welded joint may be continuous, such that a weld bead joins each attachment lug to the retained bushing.

According to different embodiments:

the first and the second collars radially abut the retaining peripheral skirt; in this case, the two collars are immobilised radially;

freeplay exists between the first and the second collars on the one hand and the retaining peripheral skirt on the other hand. This freeplay serves to facilitate assembly.

The retaining peripheral skirt advantageously has a height h1 that is lower than height h2 of the assembly formed by the first collar and the second collar. In this way, when the retaining bushing and the retained bushing are placed on either side of the two collars, they may be pressed flat against the two collars, yet the retaining peripheral skirt is not blocked by the retained ring.

More generally, the retaining bushing and the retained bushing are conformed so as to slot into one another, each one bearing axially against one of the collars.

A second aspect of the invention relates to an aircraft engine that comprises a combustion chamber according to the first aspect of the invention.

A third aspect of the invention relates to a method for attaching an injection system in a combustion chamber of an aircraft engine, wherein the combustion chamber includes a baffle comprising at least one tubular portion, the tubular portion extending in the direction of a reference axis, the tubular portion having a first upstream end surrounded by a first radially projecting collar, the injection system comprising at least one bowl that in turn comprises a cylindrical portion inserted into the tubular portion, the cylindrical portion comprising a second upstream end exiting the first upstream end of the tubular portion, the second upstream end of the cylindrical portion being surrounded by a second radially projecting collar, the second collar bearing axially against the first collar, and wherein the attachment method comprises the following steps:

(a) Clamping means are positioned on either side of the first and the second collars in such manner that said clamping means clamp the first and the second collars against one another axially; and (b) the clamping means are attached on either side of the first and the second collars in such manner that the clamping means are retained in an axially clamping position on either side of the first and the second collars.

Step (a) may be advantageously broken down as follows:

A plurality of bushing sections are inserted downstream of the first collar, the bushing sections forming a retaining bushing, the retaining bushing including at least one retaining ring and one retaining peripheral skirt projecting axially from the retaining ring, the sections of the bushing being positioned such that the first collar bears axially against the retaining ring and the retaining peripheral skirt radially surrounds the first and the second collars, A retained bushing is mounted such that it bears axially against the second collar, the retained bushing comprising a retained ring bearing axially against the second collar, the retained bushing comprising a retained peripheral skirt projecting axially from the retained ring, the retained peripheral skirt radially surrounding the retaining peripheral skirt, the first and the second collars are clamped axially between the bushing sections on the one hand and the retained bushing on the other hand.

Each section of bushing advantageously comprises at least one attachment lug, wherein each attachment lug cooperates with the retaining peripheral skirt to define a peripheral channel into which the retained peripheral skirt is inserted.

Step (b) is advantageously a step of welding each attachment lug to the retained bushing.

BRIEF DESCRIPTION OF THE DRAWING

Other features and advantages of the invention will become evident from reading the following detailed description in conjunction with the accompanying drawing, in which:

FIG. 4 shows a cross sectional view of an injection system fixed in the combustion chamber of FIG. 3;

FIG. 5 shows an enlarged cross section of the attachment of the injection system of FIG. 4 to the combustion chamber of FIG. 3;

For the sake of clarity, the same reference signs are used to identify identical or similar elements in all of the figures.

DETAILED DESCRIPTION OF AT LEAST ONE EMBODIMENT

Figure 1:
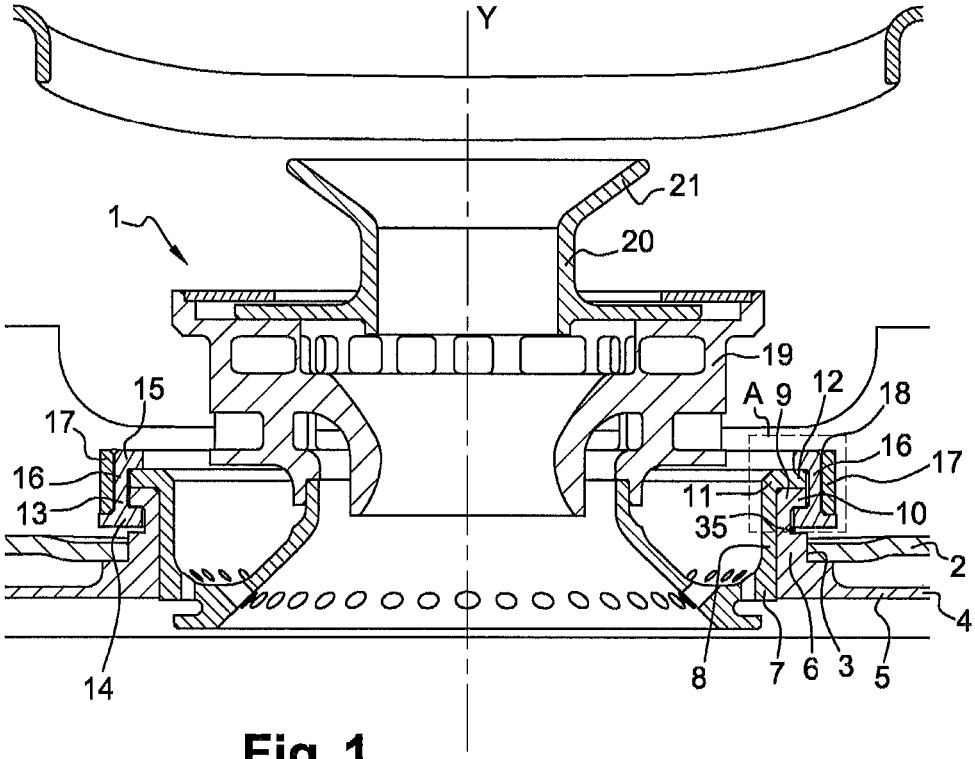
Fig. 1 PRIOR ART
FIG. 1 shows a cross sectional view of an injection system fixed in a combustion chamber of the prior art.
Figure 2:
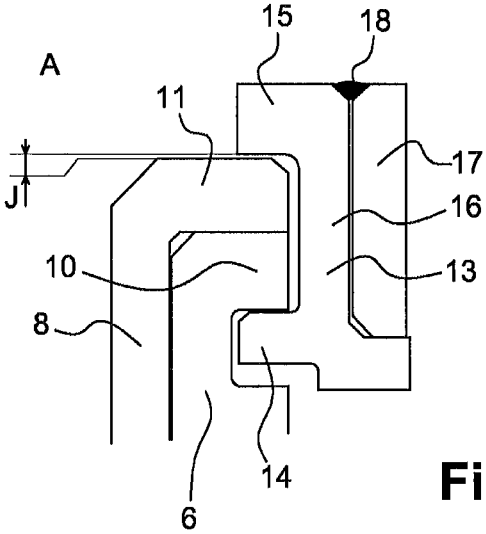
Fig. 2 PRIOR ART
FIG. 2 shows an enlarged cross section of the arrangement for attaching the injection system of FIG. 1 to the combustion chamber.
Figure 3:
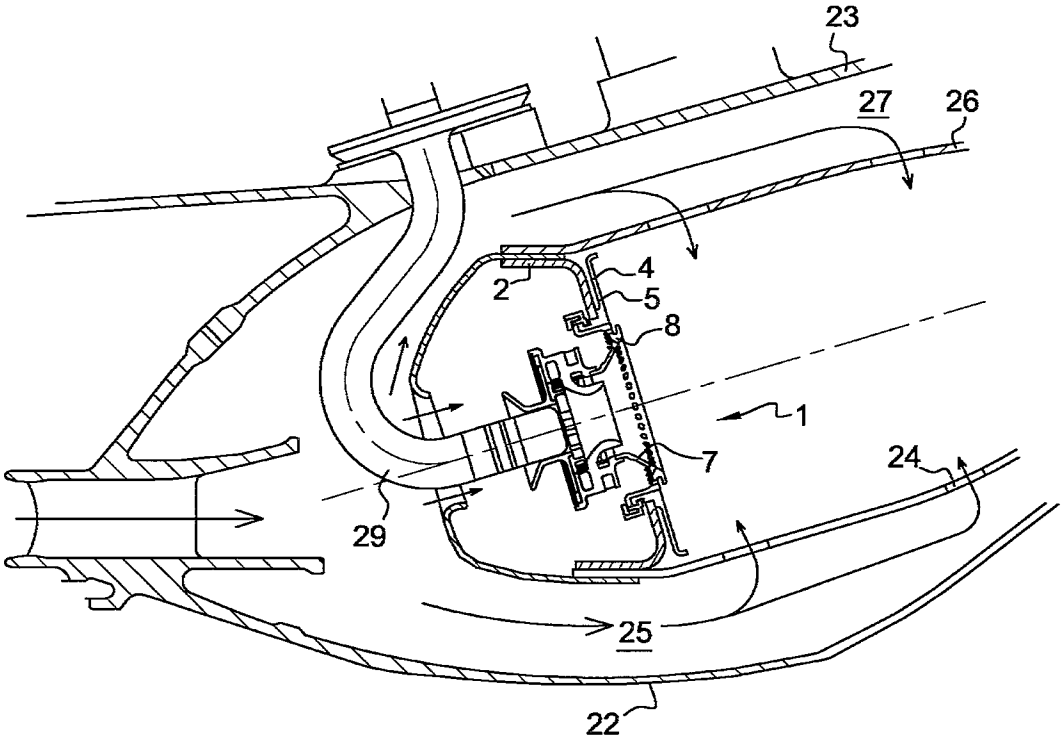
FIG. 3 shows a cross sectional view of a combustion chamber according to an embodiment of the invention.

FIGS. 3 to 5 represent a combustion chamber according to an embodiment of the invention. This combustion chamber has a shape with longitudinal rotational symmetry about a general axis of a turbine. The combustion chamber comprises an internal casing wall 22 and an external casing wall 23. An internal chamber wall 24 delimits a passage 25 with internal casing wall 22. An external chamber wall 26 delimits a passage 27 with external casing wall 23.

Internal and external chamber walls 24 and 26 connected by a chamber base 2 at the upstream ends thereof. A plurality of injection systems 1, typically fourteen to twenty-two, arranged at regular angular intervals (a single injection system is shown in FIG. 3) are provided on chamber base 2.

As may be seen in greater detail in FIG. 4, each injection system includes in particular:

a bowl 7 that is joined to a spiral structure 19, these pieces being not mobile, and a sliding cross piece 20 that is capable of moving within a cavity of spiral structure 19. Sliding cross piece 20 comprises a centring cone 21 into which a fuel injector (29) (shown in FIG. 3) will be inserted.

Baffle 4 comprises a plate 5 and a tubular portion 6. Tubular portion 6 has a rotational symmetry about a reference axis Y, and more precisely it has a cylindrical shape about reference axis Y. The function of plate 5 is to protect the base of chamber 2 from the flames in the combustion chamber. Tubular portion 6 is inserted in an orifice 3 of chamber base 2. Tubular portion 6 includes a shoulder 30 that bears axially against a downstream wall 31 of the chamber base. Baffle 4 is soldered onto chamber base 2. Tubular portion 6 has a lateral wall 33 that extends in the direction of reference axis Y. Lateral wall 33 is cylindrical about reference axis Y. Tubular portion 6 has a first upstream end 9 that is surrounded by a first radially projecting collar 10 of lateral wall 33 of tubular portion 6. Tubular portion 6 also has a radially projecting shoulder 34 of lateral wall 33. First collar 10 and shoulder 34 together define an annular channel 35 that has a rotational symmetry about reference axis Y.

Bowl 7 comprises a cylindrical portion 8 that has a rotational symmetry about reference axis Y. Cylindrical portion 8 also has a lateral wall 36 that extends in the direction of reference axis Y. Cylindrical portion 8 has a second upstream end 11 that is surrounded by a second radially projecting collar 12 of lateral wall 36 of cylindrical portion 7. Cylindrical portion 8 is inserted into tubular portion 6 in such manner that second upstream end 11 of cylindrical portion exits the first upstream end 9 of tubular portion 6.

Second collar 12 bears axially against first collar 10.

The system for attaching the injection system to the baffle according to one embodiment of the invention will now be described in greater detail with reference to FIGS. 4 and 5.

The attachment system according to the invention comprises clamping means. According to one embodiment, these clamping means include a retaining bushing 37 and a retained bushing 38.

Retaining bushing 37 comprises a retaining ring 39 that extends transversely to reference axis Y. Retaining ring 39 has a rotational symmetry about reference axis Y. Retaining ring 39 is inserted radially into annular channel 35 and bears axially against first collar 10.

Retaining bushing 37 also comprises a retaining peripheral skirt 40 that is joined to retaining ring 39. Retaining peripheral skirt 40 is arranged about the periphery of retaining ring 39 and projects axially from retaining ring 39. Retaining peripheral skirt 40 has a cylindrical symmetry about reference axis Y.

Retaining bushing 37 is split into multiple sections, shown here as two half-rings, to enable them to be inserted in annular channel 35. However, it would also be conceivable to split retaining bushing 37 into more than two sections without exceeding the boundaries of the invention.

Retaining bushing 37 also comprises at least two attachment lugs 41, each bushing section having at least one of the attachment lugs 41. According to a preferred embodiment, the retaining bushing comprises four attachment lugs 41 distributed about the periphery of retaining bushing 37. Each attachment lug 41 is connected to retaining peripheral skirt 40. Together with retaining peripheral skirt 40, attachment lugs 41 define a peripheral channel 42. Peripheral channel 42 extends around reference axis Y.

Retained bushing 38 includes a retained ring 43 that bears axially against second collar 12, and a retained peripheral skirt 44 projecting axially from second collar 12. Retained peripheral skirt 44 is arranged on the periphery of retained ring 43.

Retaining bushing 37 and retained bushing 38 are conformed such that they are able to slot into one another while retaining bushing 37 bears axially against first collar 10 and retained bushing 38 bears axially against second collar 12.

For this purpose, retaining peripheral skirt 40 has a height h1 that is lower than height h2 of the assembly formed by the first collar and the second collar that bear against one another.

Retained peripheral skirt 44 also has a height h3 that is lower than height h4 of peripheral channel 42.

The attachment system according to the invention further comprises attachment means.

In this embodiment, the attachment means comprise weld beads or weld spots 45 that join each attachment lug 41 to retained bushing 38 in such manner that retaining bushing 37 and retained bushing 38 axially clamp first and second collars 10 and 12 between them. The attachment means advantageously have four weld spots.

Each attachment lug has an upstream surface 55. Retained ring 43 has an upstream surface 54. In order to facilitate the welding of each attachment lug to the retained bushing, attachment lugs 41 and the retained bushing are dimensioned such that when retaining ring 39 is pressed flush against first collar 10 and retained ring 43 is pressed flush against second collar 12, the upstream surface 55 of each attachment lug 41 is aligned axially with the upstream surface 54 of retained ring 43.

In addition, each attachment lug 41 has a chamfered zone 57 at the intersection between the upstream surface 55 thereof and a second, lateral surface 58 of peripheral channel 42. This chamfered zone 57 is preferably bevelled.

In the same way, retained bushing 38 has a chamfered zone 56 between the upstream surface 54 thereof and the external surface 59 of retained peripheral skirt 44. This chamfered zone 56 is also preferably bevelled, such that, when retained peripheral skirt 44 is inserted in peripheral channel 42 chamfered zones 56 and 57 combine to form an annular groove 60. Weld bead 45 is preferably deposited in this annular groove 60.

Additionally, retained peripheral skirt 40 preferably has a radial dimension that is adjusted with respect to the radial dimension of annular channel 42, such that retained peripheral skirt 40 is able to enter the peripheral channel, and when retained peripheral skirt 40 is inserted in the annular channel it is at least almost completely unable to move radially.

Thus, according to the invention first collar 10 and second collar 12 are axially pressed flush against one another. There is no axial freeplay at all between retaining bushing 37, retained bushing 38 and the two collars 10 and 12, such that injection system 1 is axially immobilised relative to baffle 4.

The invention thus enables wear on the injector nozzle to be reduced. In order to further reduce wear on the injector nozzle, the invention described in this document is preferably combined with means that enable the sliding cross piece to be immobilised axially with respect to spiral structure 19.

Figure 6:
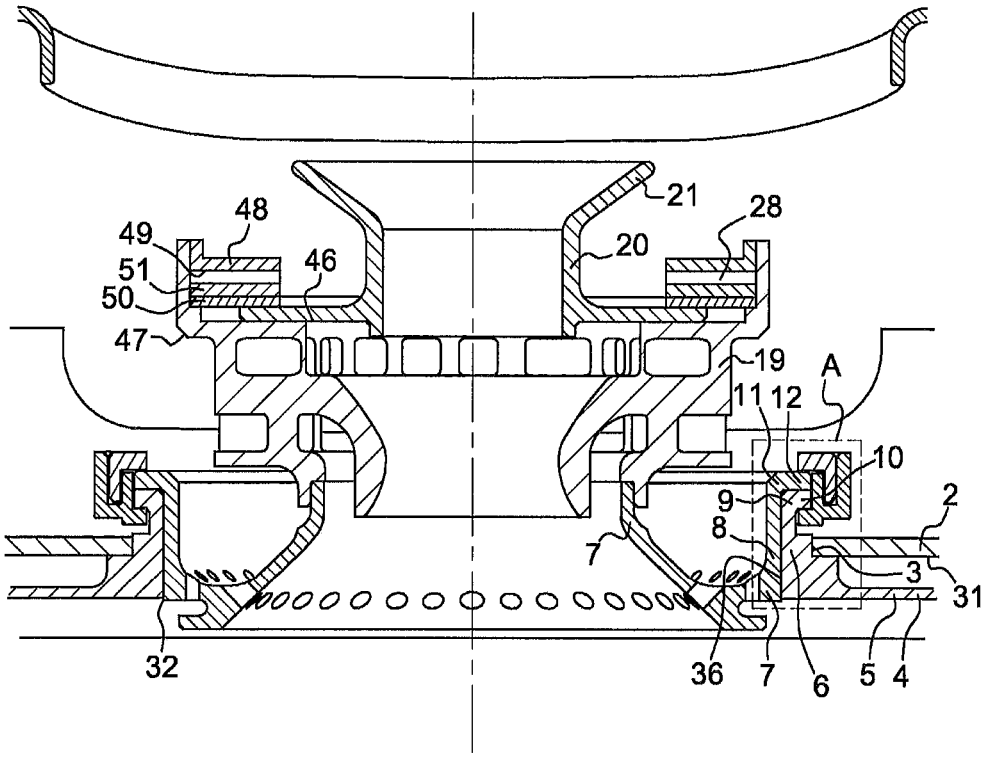
FIG. 6 shows a cross sectional view of an injection system according to another embodiment of the invention.

To this end, FIG. 6 shows a preferred embodiment in which injection system 1 is fixed on baffle 4 as described previously with reference to FIGS. 3 to 5. In addition, injection system 1 comprises immobilisation means that enables sliding cross piece 20 to be immobilised axially in cavity 28 of spiral structure 19 while still allowing the position of sliding cross piece 21 to be adjusted radially in the cavity.

To this end, sliding cross piece 20 comprises a platform 46 contained inside a cavity 28 of the spiral structure. This cavity 28 is delimited by a base 47, a closure cup 48 and a lateral wall 49. Platform 46 bears axially against base 47 of cavity 28. The immobilisation means preferably include a washer 50 that bears axially against platform 46, and spring means 51 that are restrained axially between washer 50 and closure cup 48. These spring means 51 exert a force on platform 46 that is sufficient to prevent any vibration by the sliding cross piece inside cavity 28 while still allowing the sliding cross piece to move radially and thus withstand differential expansions.

These spring means 51 advantageously comprise a corrugated metal strip in the form of a ring.

The immobilisation means are described in greater detail in the document FR 1056125.

A method for attaching the injection system inside the combustion chamber described with reference to FIGS. 3 to 5 will now be described with reference to FIGS. 7*a* to 7*c*.

Figure 7A:
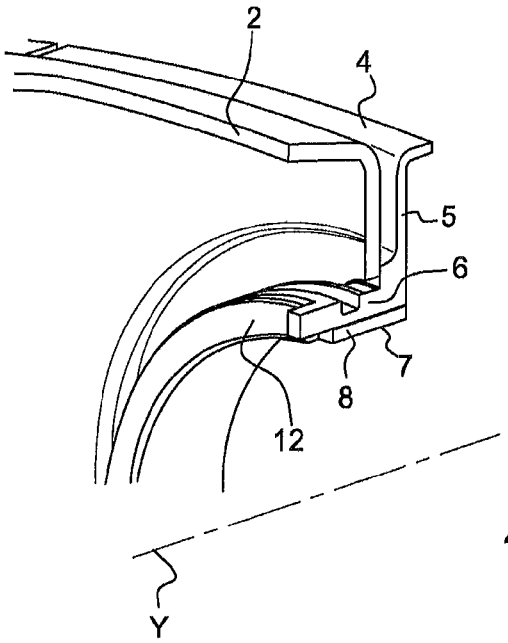
FIG. 7*a* are 7*c* are perspective views of the various steps of a method according to an embodiment of the invention.

FIG. 7*a* shows a perspective view of a chamber base 2, to which a baffle 4 is soldered. Baffle 4 comprises a plate 5 and a tubular portion 6. A bowl 7 has a cylindrical portion 8. Cylindrical portion 8 is inserted in tubular portion 6 as was described with reference to FIGS. 3 to 5.

Figure 7B:
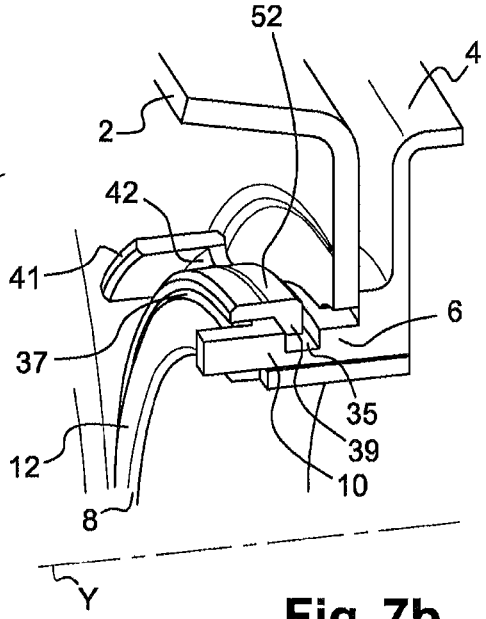

In a first step, shown in FIG. 7*b*, the bushing sections that constitute the retaining bushing, and which in this case are half-rings 52, are placed downstream of the first collar, more particularly inside annular channel 35 of tubular portion 6 of the baffle. At the end of this step, retaining ring 39 is inserted in the annular channel 35 and retaining peripheral skirt 40 surrounds first and second collars 10 and 12.

Figure 7C:
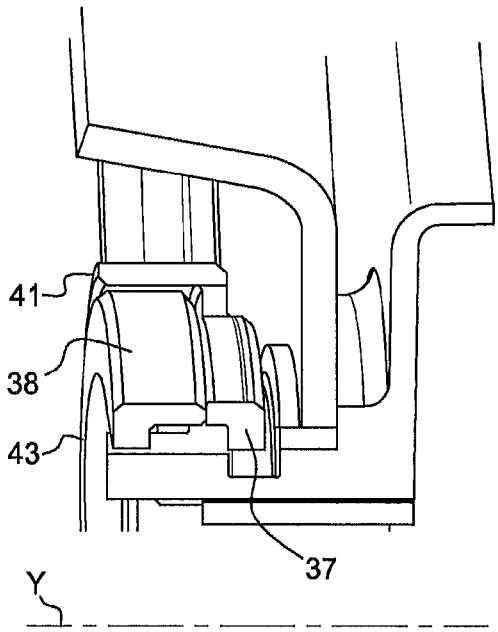

In a second step, shown in FIG. 7*c*, retained bushing 38 is placed around the two half-rings 52 in such manner that retained ring 43 bears axially against second collar 12, and retained peripheral skirt 44 is inserted in the peripheral channel 42 formed by retaining peripheral skirt 40 and attachment lugs 41.

In a third step, the two half-rings 52 and retained bushing 38 are clamped axially, using a pair or pincers or pliers for example, in such manner that they are clamped axially from both sides by the assembly consisting of first and second collars 10 and 12.

In a fourth step, attachment lugs 41 are welded to retained bushing 38. The two half-rings 52 and retained bushing 38 are thus joined together around first collar and second collar in such a position that the two collars are immobilised axially between the two half-rings 52 and retained bushing 38.

Of course, the invention is not limited to the embodiments described with reference to the figures, and variants might be conceivable without exceeding the boundaries of the invention. In particular, the geometry of the combustion chamber might be varied, as it could also be changed for any of the elements that make up the injection system. The clamping and attachment means might also have other forms.

Figure 8:
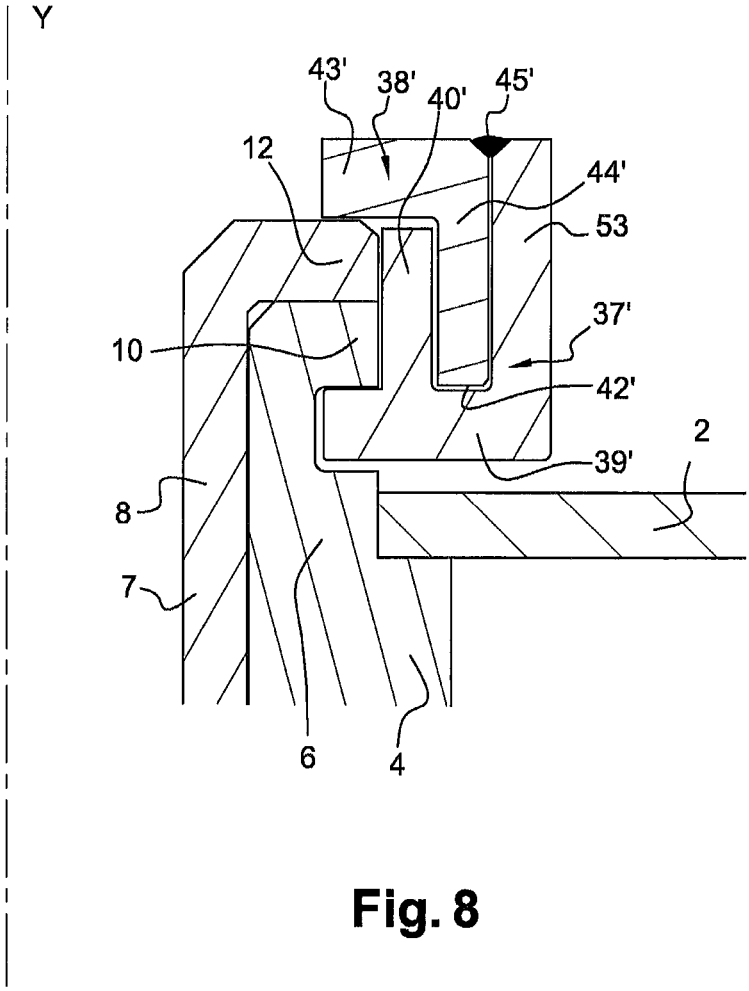
FIG. 8 shows other means of attachment and clamping that may be used inside the combustion chamber according to the invention.

For the purposes of an example, FIG. 8 shows a cross section of other means for clamping and attaching first and second collars 10 and 12. Such clamping means also comprise a retaining bushing 37' and a retained bushing 38'.

Retaining bushing 37' is split into several bushing sections, as in the embodiment described with reference to FIGS. 3 to 5. Retaining bushing 37' comprises a retaining ring 39' that extends radially. Retaining bushing 37' has an internal retaining skirt 40' that projects axially from retaining ring 39'. Retaining bushing 37' also comprises an external retaining skirt 53 that also projects axially from retaining ring 39'. Internal retaining skirt 40' and external retaining skirt 53 define a peripheral channel 42' between themselves that extends over the circumference of retaining bushing 37'.

Retained bushing 38' comprises a retained ring 43' and a retained peripheral skirt 44'. Retained peripheral skirt 44' and peripheral channel 42' are dimensioned in such manner that retained peripheral skirt 44' is able to be inserted in peripheral channel 42' without interfering with the axial bracing of retaining ring 39' against second collar 12 and axial bracing of retained ring 43' against first collar 10. In the same way, the internal retaining skirt is dimensioned such that it is able to surround the two collars 10 and 12 without interfering with the axial bracing of retaining ring 39' against second collar 12 and the axial bracing of retained ring 43' against first collar 10.

Retaining bushing 37' and retained bushing 38' axially clamp the two collars between themselves and prevent all axial movement thereof. Retaining bushing 37' and retained bushing 38' are joined in this position by a weld bead 45' that may be continuous or discontinuous.

External retaining skirt 53 has an upstream end that is substantially aligned with retained ring 43' so as to facilitate the welding of these two elements.

The invention claimed is:

1. A combustion chamber of an aircraft engine comprising:

a baffle comprising at least one tubular portion, the tubular portion extending in the direction of a reference axis, the tubular portion having a first upstream end surrounded by a first radially projecting collar;

an injection system comprising at least one bowl which comprises a cylindrical portion inserted into the tubular portion, the cylindrical portion comprising a second upstream end that exits the first upstream end of the tubular portion, the second upstream end of the cylindrical portion being surrounded by a second radially projecting collar, the second collar being braced axially against the first collar;

a clamp configured to clamp the first and the second collars against one another axially, and a fastener configured to retain the clamp clamped on either side of the first and second collars, wherein the clamp comprises a first element having a portion thereof that bears axially against the first collar and a second element, distinct from the first element and separately mountable from the first element in the combustion chamber, having a portion thereof that bears against the second collar, and wherein the first and second elements are configured to cooperate with each other to clamp the first and the second collars against one another axially.

2. An aircraft engine comprising at least one combustion chamber according to claim 1.

3. A method for attaching an injection system in an aircraft engine combustion chamber, the combustion chamber including a baffle that comprises at least one tubular portion, the tubular portion extending in the direction of a reference axis, the tubular portion having a first upstream end surrounded by a first radially projecting collar, the injection system comprising at least one bowl that comprises a cylindrical portion inserted into the tubular portion, the cylindrical portion comprising a second upstream end exiting the first upstream end of the tubular portion, the second upstream end of the cylindrical portion being surrounded by a second radially projecting collar, the second collar bearing axially against the first collar, the method comprising:

positioning a clamp on either side of the first and the second collars in such manner that said clamp clamps the first and the second collars against one another axially; and fastening the clamp on either side of the first and the second collars in such manner that the clamp is retained in an axially clamping position on either side of the first and the second collars, wherein the clamp comprises a first element having a portion thereof that bears axially against the first collar and a second element, distinct from the first element and separately mountable from the first element in the combustion chamber, having a portion thereof that bears against the second collar, and wherein the first and second elements are configured to cooperate with each other to clamp the first and the second collars against one another axially.

4. A combustion chamber of an aircraft engine comprising:

a baffle comprising a tubular portion, the tubular portion extending in the direction of a reference axis, the tubular portion having a first upstream end surrounded by a first radially projecting collar;

an injection system comprising a bowl which comprises a cylindrical portion inserted into the tubular portion, the cylindrical portion comprising a second upstream end that exits the first upstream end of the tubular portion, the second upstream end of the cylindrical portion being surrounded by a second radially projecting collar, the second collar being braced axially against the first collar;

clamping means that clamp the first and the second collars against one another axially, and attachment means that retain the clamping means clamped on either side of the first and second collars, wherein the clamping means comprise a first element having a portion thereof that bears axially against the first collar and a second element, distinct from the first element and separately mountable from the first element in the combustion chamber, having a portion thereof that bears against the second collar, and wherein the first and second elements are configured to cooperate with each other to clamp the first and the second collars against one another axially.

5. A combustion chamber of an aircraft engine comprising:

a baffle comprising at least one tubular portion, the tubular portion extending in the direction of a reference axis, the tubular portion having a first upstream end surrounded by a first radially projecting collar;

an injection system comprising at least one bowl which comprises a cylindrical portion inserted into the tubular portion, the cylindrical portion comprising a second upstream end that exits the first upstream end of the tubular portion, the second upstream end of the cylindrical portion being surrounded by a second radially projecting collar, the second collar being braced axially against the first collar;

a clamp configured to clamp the first and the second collars against one another axially, and a fastener configured to retain the clamp clamped on either side of the first and second collars, wherein the clamp comprises:

a retaining bushing split into at least two bushing sections, the retaining bushing comprising:

a retaining ring bearing axially against the first collar, and a peripheral retaining skirt projecting axially from the retaining ring, the peripheral retaining skirt surrounding the first and second collars radially, a retained bushing comprising:

a retained ring bearing axially against the second collar, and a peripheral retained skirt projecting axially from the retained ring, the peripheral retained skirt surrounding the peripheral retaining skirt radially; the fastener configured to hold together the retaining bushing and the retained bushing such that the retaining ring and the retained ring hold the first and second collars clamped against one another so that no relative axial movement between the two is possible.

6. The combustion chamber according to claim 5, wherein the tubular portion has a lateral wall, a shoulder projecting radially from the lateral wall, an annular channel being defined between the first collar and the shoulder, the retaining ring being inserted in the annular channel.

7. The combustion chamber according to claim 5, wherein the fastener comprises:

at least two attachment lugs joined to the retaining bushing, said attachment lugs combining with the retaining peripheral skirt to form a peripheral channel in which the retained peripheral skirt is inserted, at least one welded joint that fastens each attachment lug to the retained bushing.

8. The combustion chamber according to claim 5, wherein the first and second collars radially abut the retaining peripheral skirt.

9. The combustion chamber according to claim 5, wherein the retaining peripheral skirt has a height lower than a height of the assembly formed by the first collar and the second collar.

10. A method for attaching an injection system in an aircraft engine combustion chamber, the combustion chamber including a baffle that comprises at least one tubular portion, the tubular portion extending in the direction of a reference axis, the tubular portion having a first upstream end surrounded by a first radially projecting collar, the injection system comprising at least one bowl that comprises a cylindrical portion inserted into the tubular portion, the cylindrical portion comprising a second upstream end exiting the first upstream end of the tubular portion, the second upstream end of the cylindrical portion being surrounded by a second radially projecting collar, the second collar bearing axially against the first collar, the method comprising:

positioning a clamp on either side of the first and the second collars in such manner that said clamp clamps the first and the second collars against one another axially; and fastening the clamp on either side of the first and the second collars in such manner that the clamp is retained in an axially clamping position on either side of the first and the second collars, wherein the positioning comprises:

inserting a plurality of bushing sections downstream of the first collar, the bushing sections forming a retaining bushing, the retaining bushing including at least one retaining ring and one retaining peripheral skirt projecting axially from the retaining ring, the sections of the bushing being positioned such that the first collar bears axially against the retaining ring and the retaining peripheral skirt radially surrounds the first and the second collars, mounting a retained bushing such that the retained bushing bears axially against the second collar, the retained bushing comprising a retained ring bearing axially against the second collar, the retained bushing comprising a retained peripheral skirt projecting axially from the retained ring, the retained peripheral skirt radially surrounding the retaining peripheral skirt, clamping the first and the second collars axially between the bushing sections and the retained bushing.

11. The method according to claim 10, wherein each section of bushing comprises at least one attachment lug, wherein said attachment lugs cooperate with the retaining peripheral skirt to define a peripheral channel into which the retained peripheral skirt is inserted, and wherein the fastening includes welding the attachment lugs to the retained bushing.

12. A combustion chamber of an aircraft engine comprising:

a baffle comprising a tubular portion, the tubular portion extending in the direction of a reference axis, the tubular portion having a first upstream end surrounded by a first radially projecting collar;

an injection system comprising a bowl which comprises a cylindrical portion inserted into the tubular portion, the cylindrical portion comprising a second upstream end that exits the first upstream end of the tubular portion, the second upstream end of the cylindrical portion being surrounded by a second radially projecting collar, the second collar being braced axially against the first collar;

clamping means that clamp the first and the second collars against one another axially, and attachment means that retain the clamping means clamped on either side of the first and second collars, wherein the clamping means comprise:

a retaining bushing split into at least two bushing sections, the retaining bushing comprising:

a retaining ring bearing axially against the first collar, and a peripheral retaining skirt projecting axially from the retaining ring, the peripheral retaining skirt surrounding the first and second collars radially, a retained bushing comprising:

a retained ring bearing axially against the second collar, and a peripheral retained skirt projecting axially from the retained ring, the peripheral retained skirt surrounding the peripheral retaining skirt radially; the attachment means holding together the retaining bushing and the retained bushing such that the retaining ring and the retained ring hold the first and second collars clamped against one another so that no relative axial movement between the two is possible.

13. The combustion chamber according to claim 12, wherein the tubular portion has a lateral wall, a shoulder projecting radially from the lateral wall, an annular channel being defined between the first collar and the shoulder, the retaining ring being inserted in the annular channel.

14. The combustion chamber according to claim 12, wherein the attachment means comprises:

two attachment lugs joined to the retaining bushing, said attachment lugs combining with the retaining peripheral skirt to form a peripheral channel in which the retained peripheral skirt is inserted, a welded joint that fastens each attachment lug to the retained bushing.

* * * * *